US007530754B2

(12) United States Patent
Demuth et al.

(10) Patent No.: US 7,530,754 B2
(45) **Date of Patent: *May 12, 2009**

(54) FLUID SQUEEGEE HEAD

(75) Inventors: Kade Howard Demuth, Saskatchewan (CA); Sheldon Foss, Alberta (CA)

(73) Assignee: Kadon Industries Ltd., Alberta (CA)

( * ) Notice: Subject to any disclaimer, the term of this patent is extended or adjusted under 35 U.S.C. 154(b) by 311 days.

This patent is subject to a terminal disclaimer.

(21) Appl. No.: 11/504,310

(22) Filed: Aug. 15, 2006

(65) Prior Publication Data

US 2007/0020039 A1 Jan. 25, 2007

Related U.S. Application Data

(60) Division of application No. 10/836,668, filed on Apr. 30, 2004, now Pat. No. 7,287,926, which is a continuation-in-part of application No. 10/443,420, filed on May 22, 2003, now Pat. No. 6,808,332.

(51) Int. Cl.
*B05C 11/00* (2006.01)
*A47L 13/26* (2006.01)

(52) U.S. Cl. ..... 401/266; 401/265; 401/139

(58) Field of Classification Search ..... 401/261–266, 401/140, 25, 26, 137–139; 15/121
See application file for complete search history.

(56) References Cited

U.S. PATENT DOCUMENTS

| | | | |
|---|---|---|---|
| 556,722 | A | 3/1896 | Ford |
| 1,218,040 | A | 3/1917 | Armstrong |
| 1,572,913 | A | 2/1926 | Finnell |
| 1,656,208 | A | 1/1928 | LeVora |
| 1,783,506 | A | 12/1930 | Homiller |
| 2,246,640 | A | 6/1941 | Shurhay |
| 2,497,674 | A | 2/1950 | Kolchinsky |
| 2,521,967 | A | 9/1950 | Dean |

(Continued)

FOREIGN PATENT DOCUMENTS

| | | |
|---|---|---|
| WO | WO 94/24920 | 11/1994 |

*Primary Examiner*—David J Walczak
(74) *Attorney, Agent, or Firm*—Dinsmore & Shohl LLP

(57) ABSTRACT

A fluid squeegee comprises nozzles in the squeegee head for spraying a fluid, such as water, onto a surface to be cleaned and a squeegee blade on the squeegee head for clearing away the fluid from the surface. A molded unit for the squeegee head includes a channel shaped mounting plate having a web portion between a lower flange portion and an upper flange portion. A squeegee blade is adapted to be mounted to the lower flange portion and nozzles are adapted to be mounted in the mounting plate or in a nozzle plate that is fixed over an aperture in the mounting plate. Hollow brace members and a hollow shaft socket are positioned on the intake side of the mounting plate. The hollow shaft socket includes discharge ports that are aligned with the hollow brace members, which extend radially away from the nozzle. The hollow brace members enclose the nozzles so as to create a sealed fluid passageway between the hollow shaft socket and the nozzles. The fluid squeegee further includes a hollow shaft and hollow handle, which are connected between a hose and the squeegee head such that fluids can be sprayed onto a surface to be cleaned via the nozzles. The hollow brace members are beneficial in that they provide additional structural support between the head and a hollow fluid shaft inserted into the socket.

11 Claims, 19 Drawing Sheets

U.S. PATENT DOCUMENTS

| | | | | |
|---|---|---|---|---|
| 2,638,730 | A | 5/1953 | Davidson | |
| 2,692,163 | A | 10/1954 | Geel | |
| 2,746,072 | A | 5/1956 | Lumpkin | |
| 3,082,467 | A | 3/1963 | Wells | |
| 3,134,129 | A | 5/1964 | Allen | |
| 3,837,747 | A | 9/1974 | Seymore | |
| 4,095,746 | A | 6/1978 | Anderberg et al. | |
| 4,778,298 | A | 10/1988 | Shin et al. | |
| 5,007,753 | A | 4/1991 | England, Jr. | |
| 5,271,682 | A | 12/1993 | Realdon | |
| 5,364,198 | A | 11/1994 | Skenderi | |
| 5,386,612 | A | 2/1995 | Sham | |
| 6,250,831 | B1 | 6/2001 | Craven | |
| 6,419,415 | B1 | 7/2002 | Vosbikian et al. | |
| 6,808,332 | B1 | 10/2004 | Demuth et al. | |
| 7,008,130 | B1 * | 3/2006 | Hill | 401/27 |

* cited by examiner

FLUID SQUEEGEE HEAD

This application is a division of U.S. patent application Ser. No. 10/836,668 filed Apr. 30, 2004, now U.S. Pat. No. 7,287,926, which is a continuation-in-part of U.S. application Ser. No. 10/443,420 filed May 22, 2003, now U.S. Pat. No. 6,808,332.

FIELD OF THE INVENTION

The present invention relates generally to surface cleaning devices, and more particularly to a fluid squeegee.

BACKGROUND OF THE INVENTION

Floor cleaning devices adapted for attachment to a fluid hose are well known in the prior art. For example, U.S. Pat. No. 2,246,640 issued to Shurhay and U.S. Pat. No. 4,095,746 issued to Anderberg et al., both describe a water sweeping device including a pair of tubular members attached by a "T" fitting. These tubular members form a handle member and a cross member respectively, the latter having spray nozzles mounted therein. During operation, fluid flows through the hollow handle into the "T" fitting where it is distributed to the cross member and, ultimately, ejected onto a cleaning surface.

There are two major drawbacks to the cleaning devices described above. First, the sharp corners of the "T" fitting are prone to fatigue cracks which result from oscillating forces applied during a cleaning operation. Second, the tubular cross members are prone to excessive bending.

A cleaning device for windows is described in U.S. Pat. No. 5,271,682 issued to Realdon, this device has a short tubular cross-member support with a holder with a brush and a squeegee pivotally mounted on the support. A further brush cleaning device with a squeegee for cleaning floors is described in U.S. Pat. No. 6,419,415 issued on Jul. 16, 2002. Both of these devices include a brush as an integral part of the cleaning device structure.

Therefore there is a need for an improved fluid squeegee.

SUMMARY OF THE INVENTION

It is an object of the present invention to provide a fluid squeegee, which obviates or mitigates at least one of the disadvantages described above.

This invention is directed to a fluid squeegee for spraying a fluid, such as water, from nozzles in the squeegee head onto a surface to be cleaned and for clearing away the fluid from the surface by a squeegee blade on the squeegee head.

In accordance with one aspect of the invention, a molded unit for a squeegee head comprises a mounting plate that has a front discharge face and a back intake face, a mounting portion for attaching a squeegee blade thereto and an aperture for receiving a nozzle plate. The unit also includes a hollow shaft socket located on the intake face of the mounting plate wherein the hollow shaft socket is adapted for attachment to a hollow fluid shaft, and one or more hollow brace members, also located on the intake face of the mounting plate and extending radially away from hollow shaft socket to enclose the nozzle plate aperture, whereby the hollow brace members form a sealed fluid passageway between the hollow shaft socket and the nozzle plate aperture.

In accordance with another aspect of this invention, a squeegee head comprises a molded squeegee head unit, a nozzle plate having one or more nozzles; and a squeegee blade. The squeegee head unit comprises a mounting plate that has a front discharge face and a back intake face, a mounting portion for attaching the squeegee blade thereto and an aperture for receiving the nozzle plate. The unit also includes a hollow shaft socket located on the intake face of the mounting plate wherein the hollow shaft socket has one or more discharge ports formed therein and is adapted for attachment to a hollow fluid shaft. Further, one or more hollow brace members, also located on the intake face of the mounting plate and extending radially away from the discharge ports in the hollow shaft socket to enclose the nozzle plate aperture, whereby the hollow brace members form a sealed fluid passageway between the hollow shaft socket and the nozzles in the nozzle plate aperture.

In accordance with a specific aspect of the invention, the hollow brace members may have an inner surface that is semi-conical in shape and may be positioned such that the tapered ends of the semi-conical braces are furthest from the socket, or alternately the hollow brace members may have an inner surface that is semi-cylindrical in shape.

In accordance with a further aspect of the invention, the mounting plate may be channel shaped defining a web portion between a lower flange portion and an upper flange portion. The hollow socket, the hollow brace members and the nozzle plate aperture are all located on the web portion and the squeegee blade is mounted on the lower flange portion.

In accordance with further specific aspects of the invention, the upper flange portion may have a serrated edge, reinforcement ribs may structurally connect the hollow shaft socket and the hollow brace members, and a support member may structurally connect the hollow shaft socket and the intake face of the mounting plate.

In accordance with another specific aspect of the invention, the mounting plate may have ends that are curved inwardly toward the discharge face.

In accordance with an aspect of the invention, the squeegee includes a hollow fluid shaft having an intake end and a discharge end that is adapted for sealing attachment to the hollow shaft socket, a hollow handle adapted for sealing attachment to said intake end of the hollow shaft and to a fluid hose, and a valve mechanism located in the hollow handle for controlling fluid flow there through.

Other aspects and advantages of the invention, as well as the structure and operation of various embodiments of the invention, will become apparent to those ordinarily skilled in the art upon review of the following description of the invention in conjunction with the accompanying drawings.

BRIEF DESCRIPTION OF THE DRAWINGS

The invention will be described with reference to the accompanying drawings, wherein.

DETAILED DESCRIPTION OF THE INVENTION

Figure 1A:
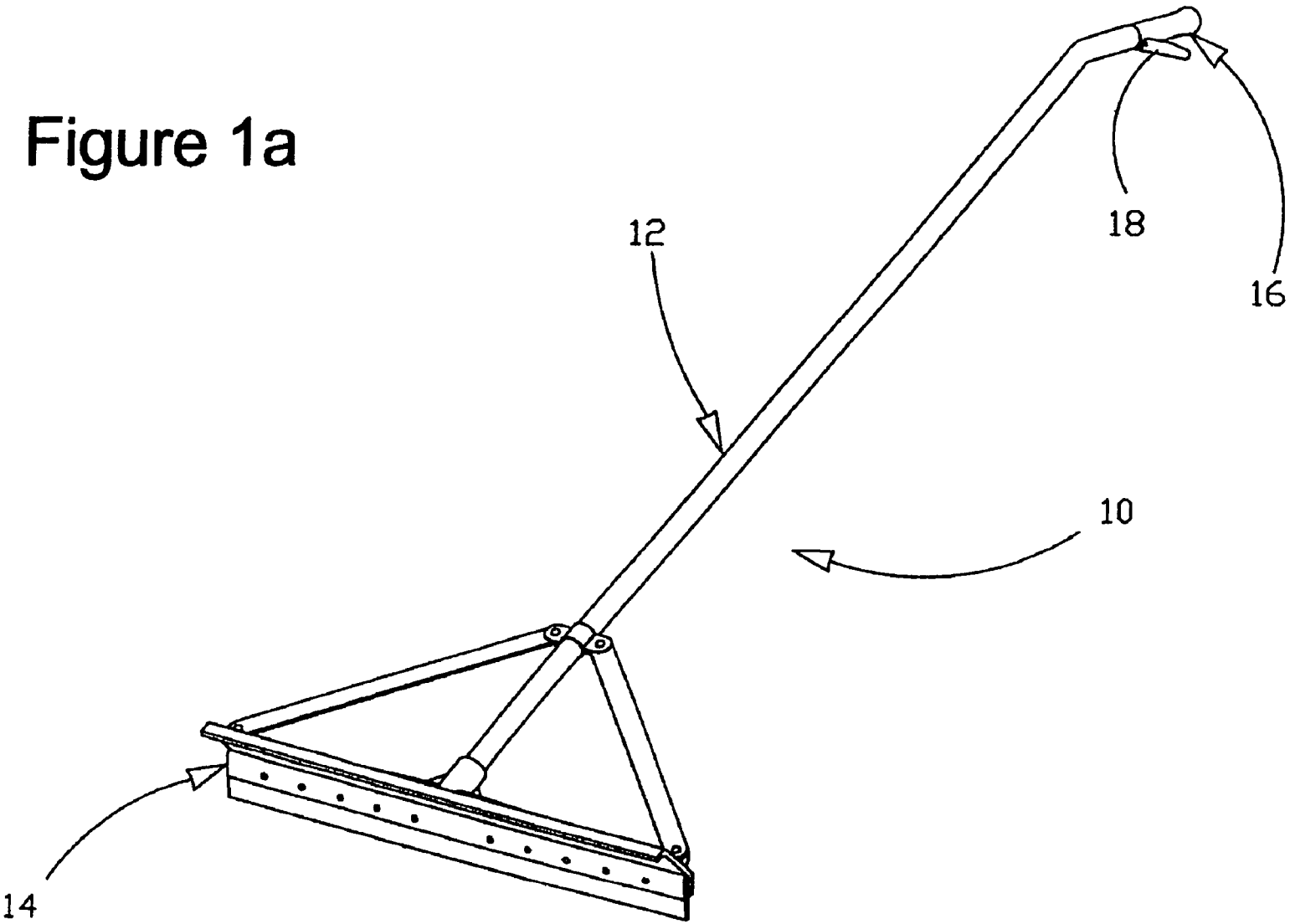
FIG. 1*a* presents an isometric view of a fluid squeegee in accordance with an embodiment of the present invention.

With reference to FIG. 1*a* there is shown a fluid squeegee in accordance with an embodiment of the invention described above in the summary, depicted generally by reference number 10. Fluid squeegee 10 includes hollow fluid shaft 12 to which is attached squeegee head 14 at one end, and hollow handle 16 at the other. According to this embodiment of the invention, hollow handle 16 is adapted for sealing attachment to a fluid hose, such as a garden hose, via mechanical threads (not shown). Also included in handle 16 is a valve 18 for controlling the flow of fluid through hollow handle 16, shaft 12, and, ultimately, head 14.

Figure 1B:
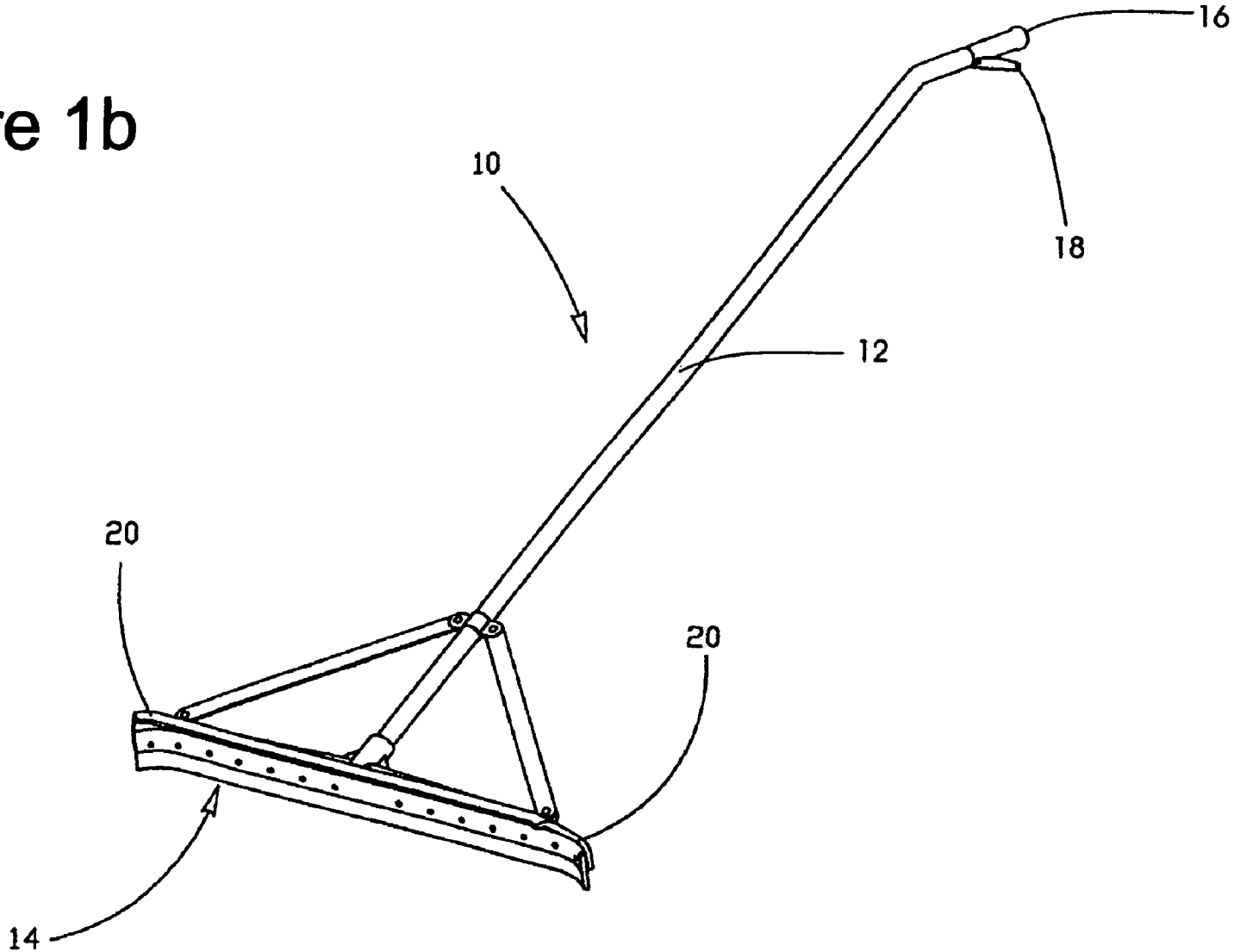
FIG. 1*b* illustrates an isometric view of a fluid squeegee in accordance with another embodiment of the present invention.

FIG. 1*b* presents an alternative embodiment of the present invention wherein ends 20 of the squeegee head 14 are curved inwardly towards the front or discharge face of head 14. This arrangement is designed to reduce fluid flow around ends 20 during operation of squeegee 10.

Figure 2A:
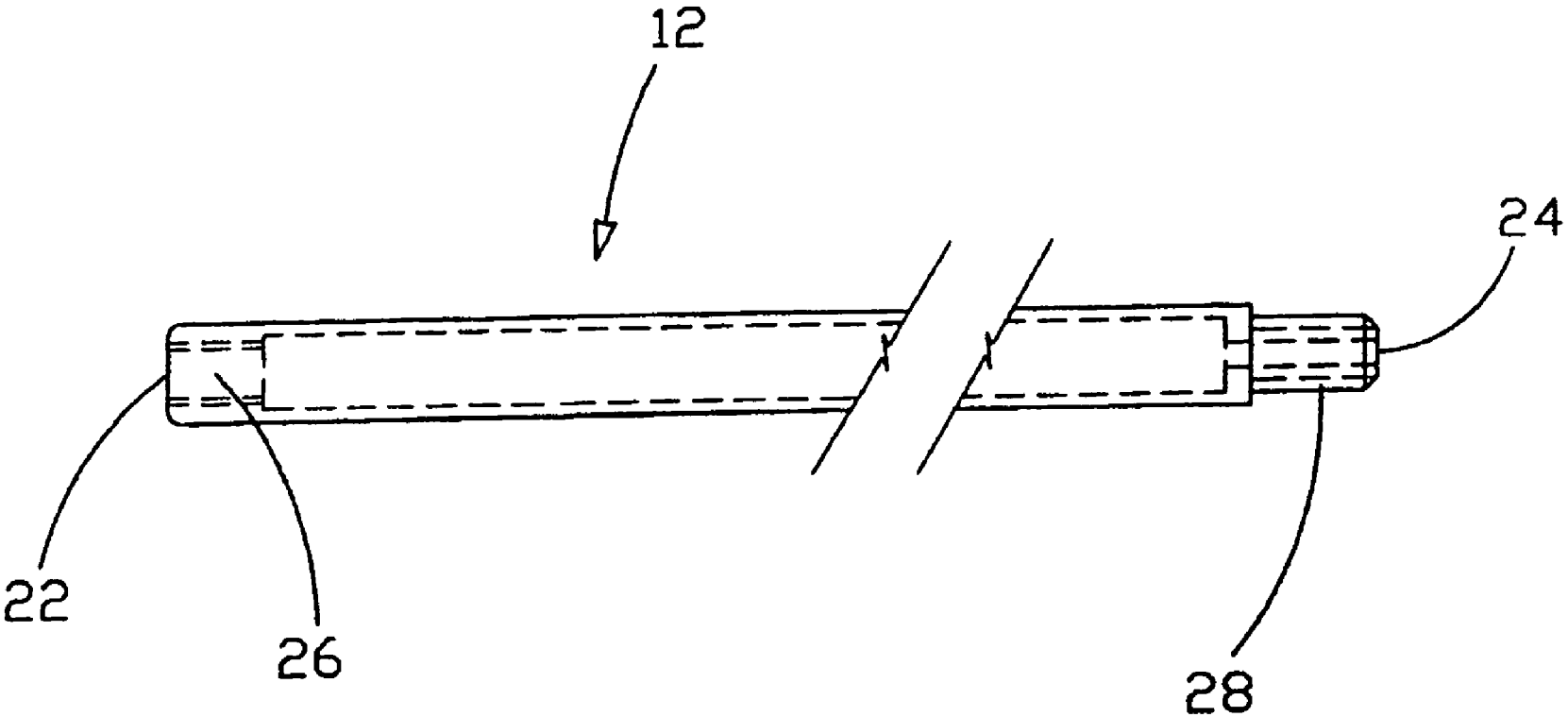
FIG. 2*a* presents a side elevation of a hollow shaft in accordance an embodiment of the present invention.
Figure 2C:
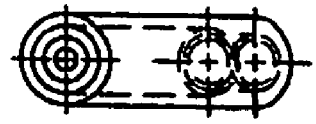
FIG. 2*c* presents a front elevation of a hollow shaft in accordance with another embodiment of the present invention.
Figure 2B:
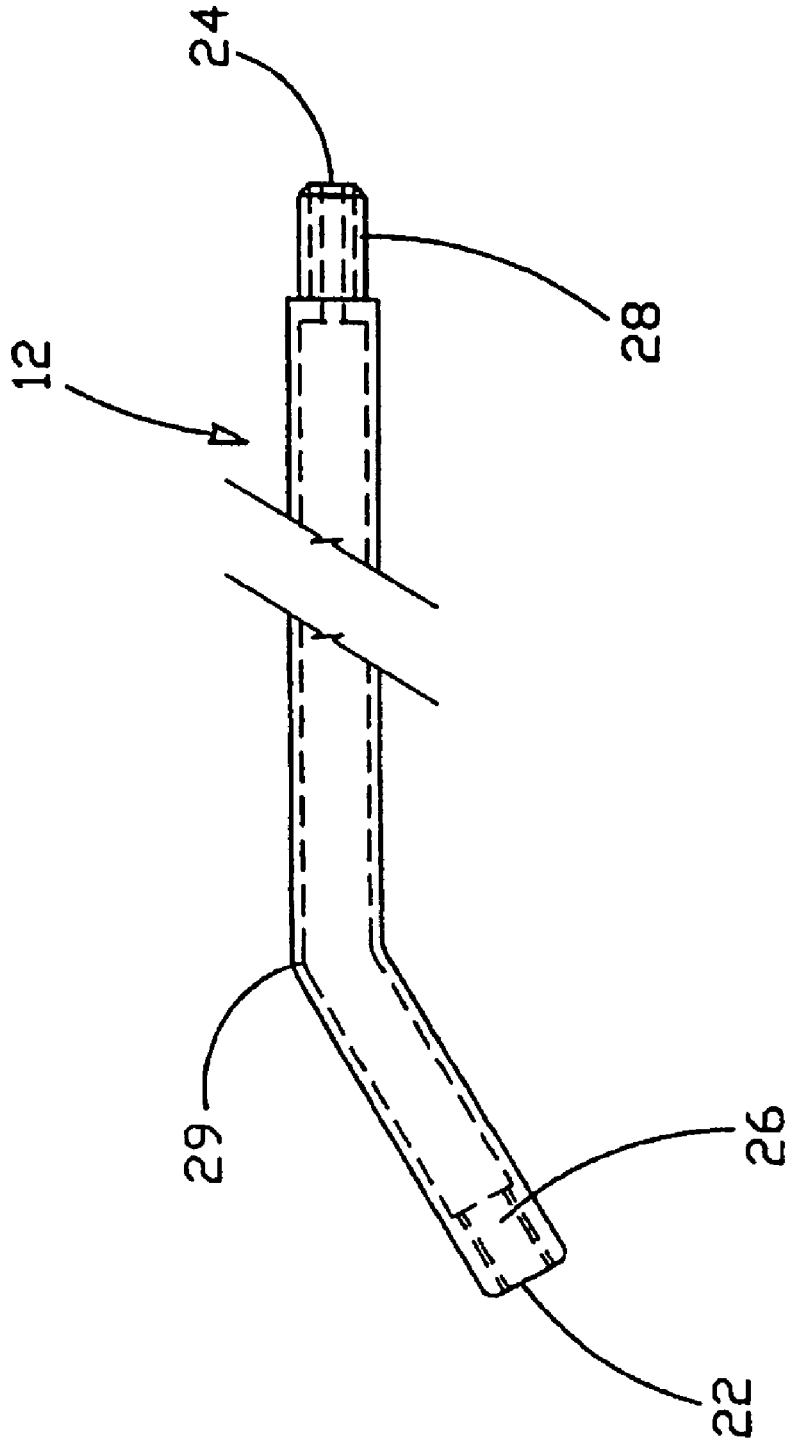
FIG. 2*b* presents a side elevation of a hollow shaft in accordance with another embodiment of the present invention.

A close-Lip side view of hollow fluid shaft 12 is shown in FIG. 2*a*. Hollow fluid shaft 12 includes an intake end 22 and a discharge end 24. Intake end 22 is adapted for sealing attachment to a fluid hose or alternatively, as in the preferred embodiment of the invention, hollow handle 16. To facilitate such attachment intake end 22 includes female receptacle 26, which, in the preferred embodiment of the invention, is designed to accept a standard ¾" hose thread. Similarly, discharge end 24 is adapted for sealing attachment to squeegee head 14. To facilitate this connection, the preferred embodiment of the invention includes male protrusion 28 into which are formed standard acme or broom threads (not shown). As shown in FIGS. 2*b* and 2*c*, hollow fluid shaft 12 may also include an angle or bend 29, which will minimize the flex required in the attached hose and will improve operator comfort.

Although female and male attachment members are described for attaching shaft 12 to head 14 and handle 16 respectively, a person skilled in the art will appreciate that this arrangement could be inverted without affecting the operation of the invention described above in the summary. The only requirement is that the piece to which a respective end attaches must have the corresponding male or female member formed therein. A person skilled in the art will recognize, however, that mechanical threads are not essential and could, for example, be replaced by a snap fit arrangement or any other means known in the art.

Figure 3:
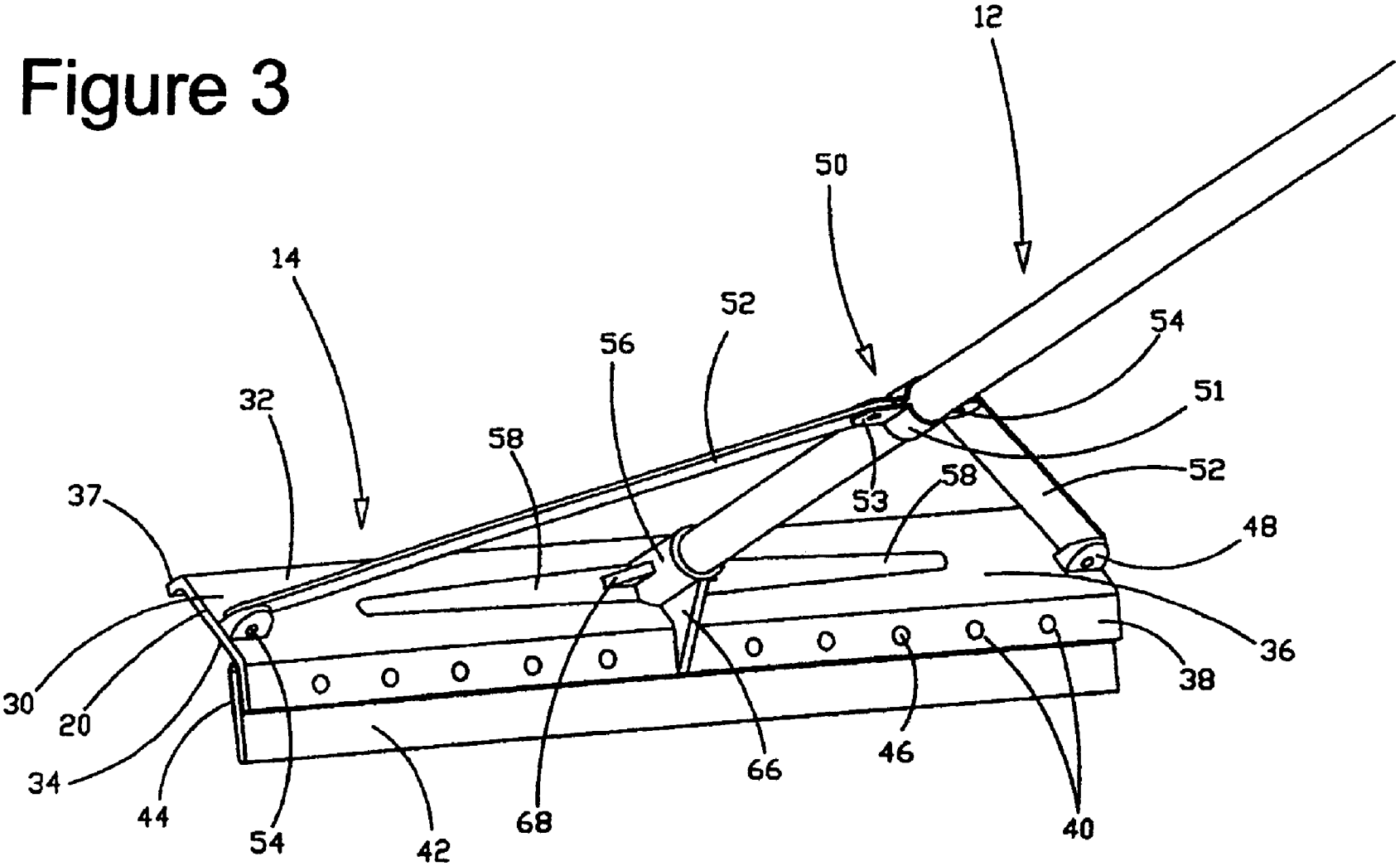
FIG. 3 presents an isometric view of a squeegee head in accordance with an embodiment of the present invention.

FIG. 3 provides a detailed isometric view of the squeegee head 14 as seen from the back of the head 14. The hollow fluid shaft 12 is shown attached to the head 14. Squeegee head 14 includes mounting plate 30 which plate includes a back or intake face 32 and a front or discharge face 34. In accordance with this embodiment of the invention, mounting plate 30 is elongated and channel shaped thus defining a web section 36, an upper flange 37 and a lower flange 38. As will be apparent to one skilled in the art, flanges 37 and 38 will assist in restricting the bending of mounting plate 30 that may otherwise occur in a mounting plate 30 that is flat. Extending through flange 38 are mounting apertures 40 into which fasteners 46 are inserted to mount squeegee blade 42, and blade mounting strip 44, thereto. As will be apparent to one skilled in the art, mounting apertures 40 are not essential to the invention described in the summary. For example, flange 38 could itself define a channel (not shown) into which blade 42 could be slid. Blade 42 could then be secured within said channel using any means known in the art, including, but not limited to, placing a fastener through both ends of flange 38.

To reduce bending stresses which occur between hollow fluid shaft 12 and squeegee head 14 support members 52 are mounted there between. To facilitate attachment of support members 52 to squeegee head 14, mounting eyelets 48 are positioned at ends 20 of intake face 32. Mounting eyelets 48 are adapted to receive fastener 54, which fastener is also adapted to pass through an aperture (not shown) in support member 52. The other end of support member 52 is similarly attached to an attachment sleeve 50 via a fastener 54. In accordance with this embodiment of the invention, sleeve 50 includes two semi-circular members 51 having lateral mounting flanges 53 extending there from, the inside diameter of members 51 being slightly larger in size than the outside diameter of shaft 12.

As will be apparent to one skilled in the art, support members 52 provide greater structural support to shaft 12 thereby impeding the formation of fatigue cracks between shaft 12 and head 14.

To facilitate attachment of hollow fluid shaft 12 to squeegee head 14, a hollow shaft socket 56 is situated adjacent to intake face 32 of squeegee head 14 and extends outwardly there from. In accordance with this embodiment of the invention, hollow shaft socket 56 includes mechanical threads (not shown) corresponding to those on male protrusion 24 of hollowfluid shaft 12.

Extending radially from hollow shaft socket 56 along intake face 32 are two hollow brace members 58. In accordance with this embodiment of the invention, brace members 58 are semi-conical in shape and taper in size as they extend away from socket 56.

Figure 5:
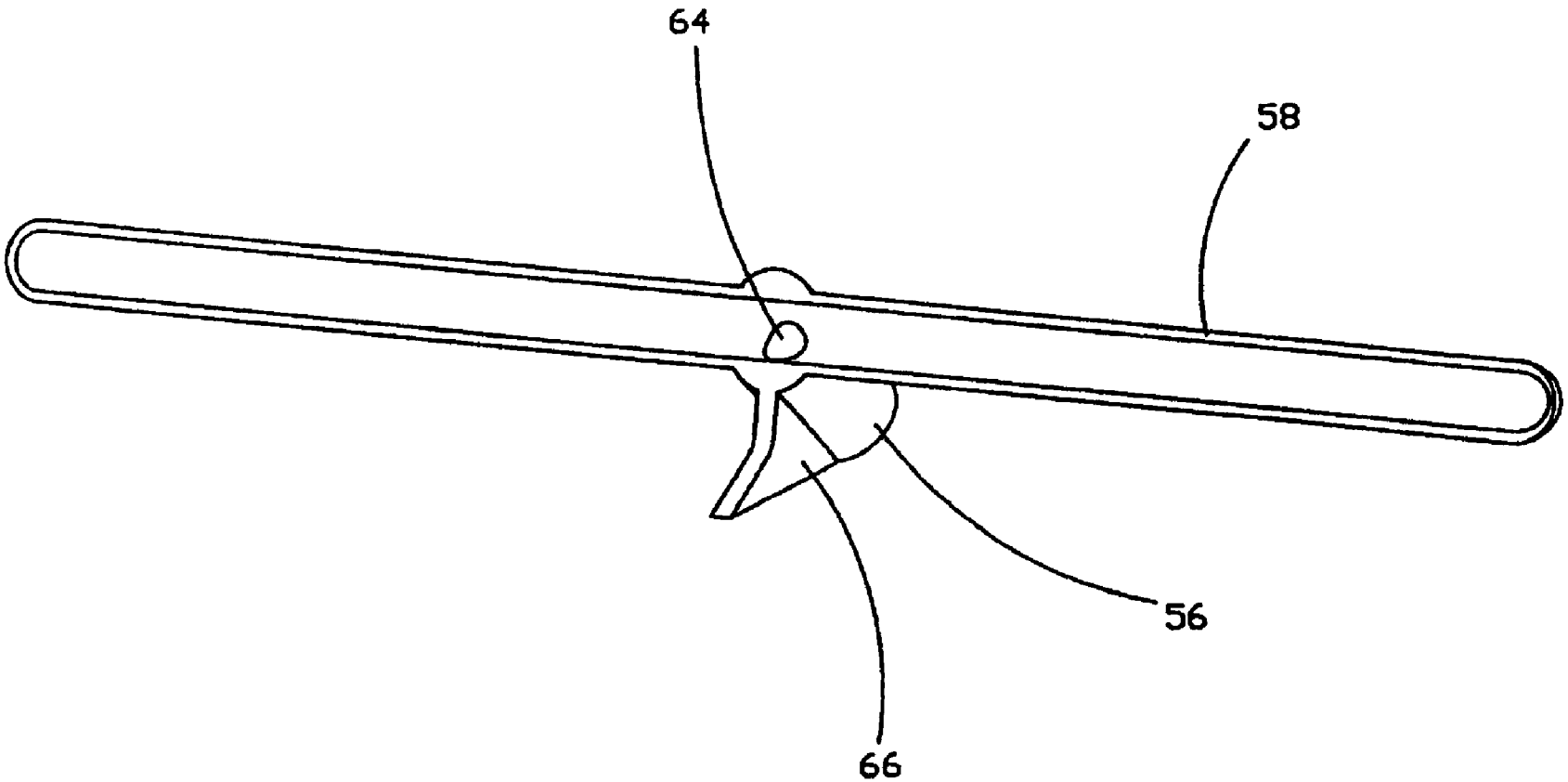
FIG. 5 presents an isometric view of hollow shaft socket and hollow brace member in accordance with an embodiment of the present invention.

Although the hollow brace members 58 are shown as being semi-conical in shape, one skilled in the art will appreciate that other shapes for these members would be equally effective in implementing the present invention. For example, similar structural support could be achieved using semi-cylindrical members such as illustrated in FIG. 5 or U-shaped members. Similarly, the invention described is not limited to two hollow brace members 58. In fact, as one skilled in the art will appreciate, the greater the number of hollow brace members 58 employed, the greater the structural integrity that might be achieved.

Figure 4A:
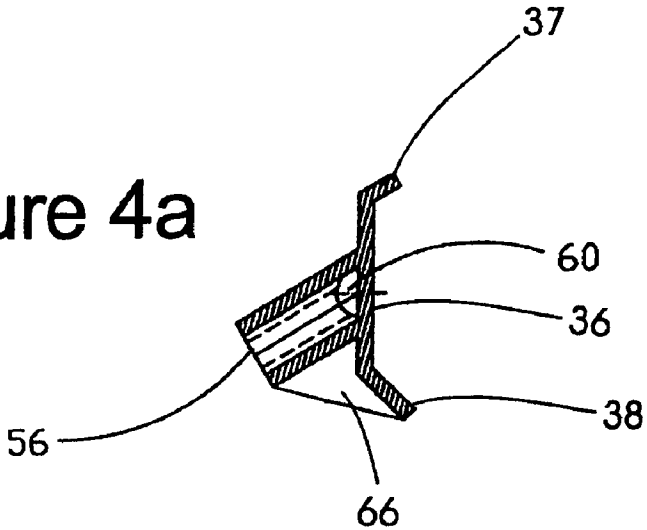
FIG. 4*a* presents a side section view of a squeegee head in accordance with an embodiment of the present invention as shown along section line A-A of FIG. 4*b;*
Figure 4B:
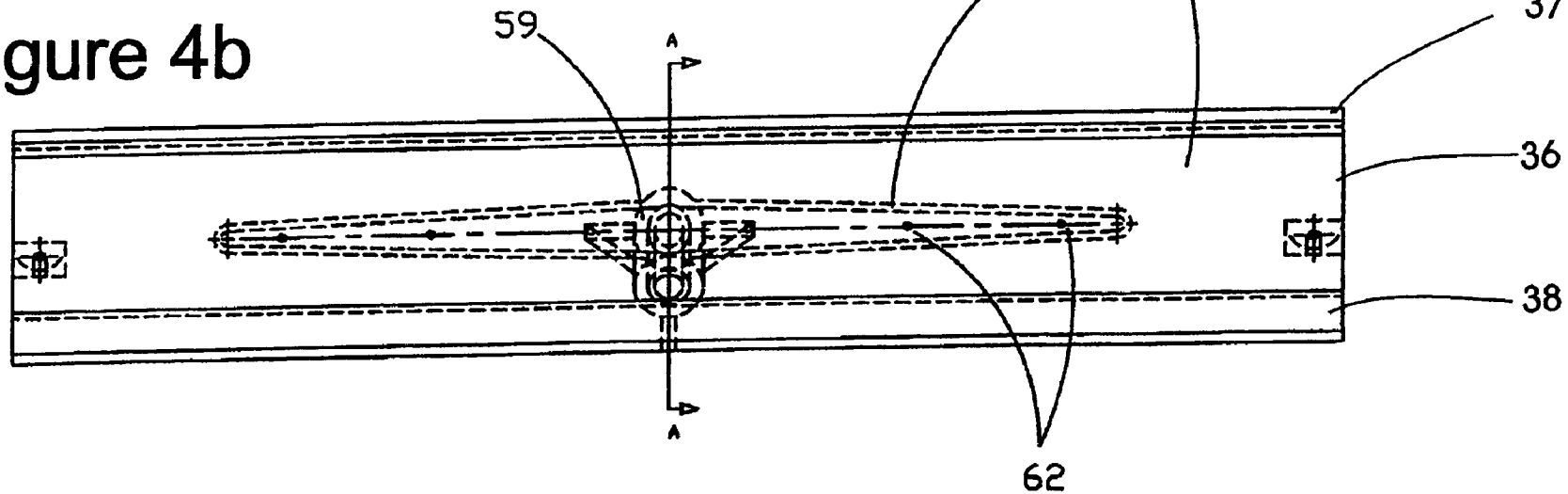
FIG. 4*b* presents a bottom view of a squeegee head in accordance with an embodiment of the present invention.

Referring to FIG. 4*a*, a side section of squeegee head 14 is shown along cutting line A-A of FIG. 4*b*. As shown therein, hollow shaft socket 56 has discharge port 60 formed on each side of the socket 56. In accordance with this embodiment of the invention, discharge ports 60 is semi-circular in cross section having a radius corresponding to the inside radius of hollow brace members 58 at their intake ends 59. As will be apparent to one skilled in the art of fluid mechanics, smooth transitions between various parts of a fluid passageway are beneficial for minimizing fluid pressure loss.

As shown in FIG. 4*b*, hollow brace members 58 enclose discharge nozzles 62, which are incorporated in and extend through mounting plate 30. Hollow brace members 58 thereby creating a sealed fluid passageway between hollow discharge socket 56 and nozzles 62. Though the nozzles may form an integral part of the mounting plate 30, discrete nozzles made of metal or other material may be fitted into openings in the mounting plate 30, as by press fitting.

In accordance with another embodiment of the invention, hollow shaft socket 56 and the two hollow brace members 58 may form a single piece as shown in FIG. 5. The hollow brace members 58 may have a constant cross-section along their length forming a semi-cylindrical or similar shape. As this piece is viewed from its hollow side, discharge opening 64 can be seen extending through hollow shaft socket 56. Also shown is support member 66 which member is adapted for attachment to back or intake face 32 of mounting plate 30 as shown in FIG. 3. Also, as shown in FIG. 3, ribs or gussets 68 are located on either side of the hollow shaft socket 56 and attached to the hollow brace members 58 to provide further structural support to hollow shaft socket 56.

Figure 6:
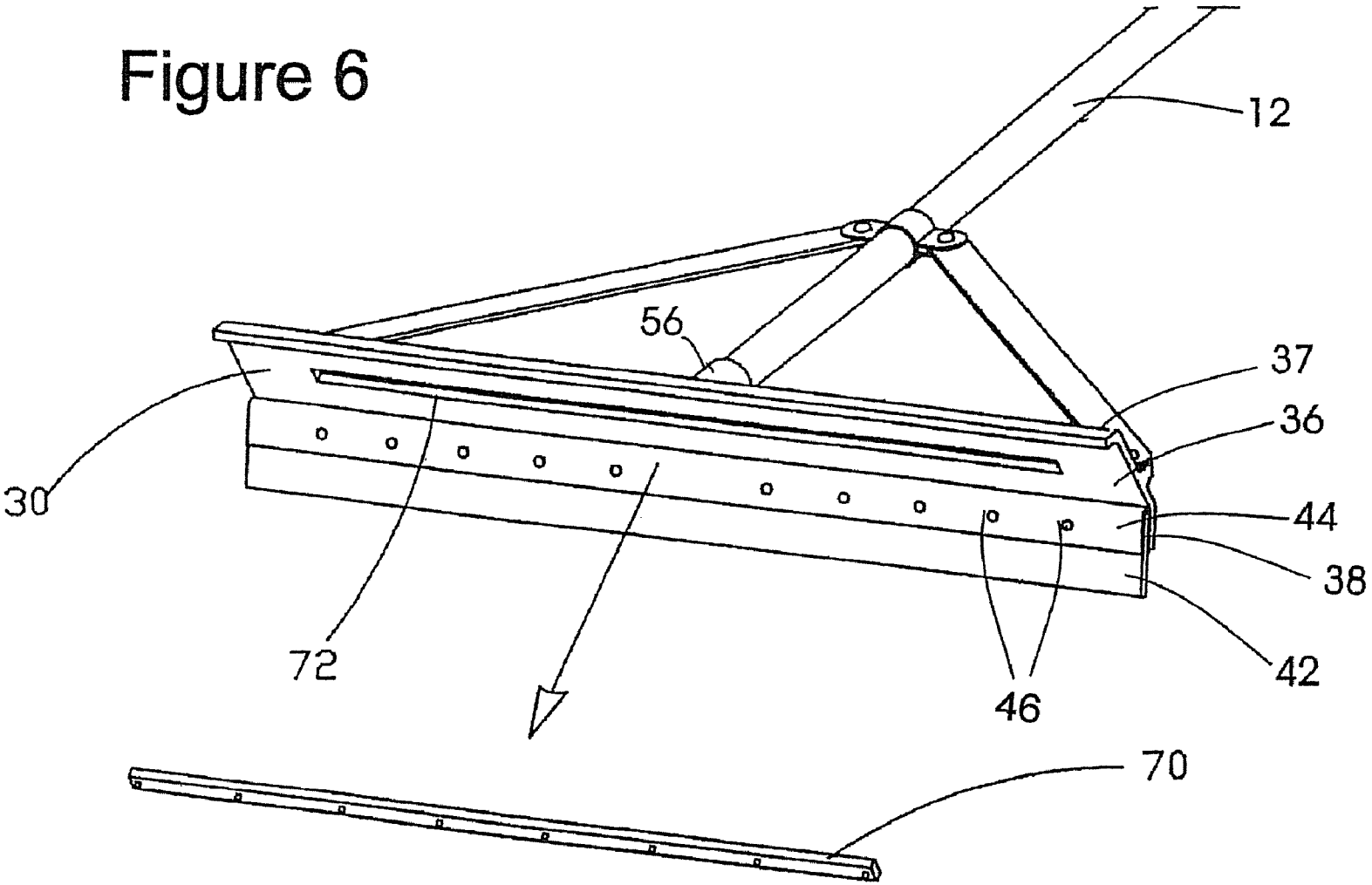
FIG. 6 presents an exploded isometric view of a mounting plate and nozzle plate in accordance with another embodiment of the present invention.

In an alternative embodiment of the invention as shown in FIG. 6, mounting plate 30 includes a nozzle plate 70, which includes a substantial portion of the area that is enclosed by hollow brace members 58 and hollow shaft socket 56. To mount nozzle plate 70 to mounting plate 30, a corresponding nozzle aperture 72 is formed in the mounting plate 30. As will be apparent to one skilled in the art, a watertight seal between nozzle plate 70 and mounting plate 30 can be achieved through use of a gasket, silicone, or any other means known in the art. Alternately, the nozzle plate 70 may be larger than the nozzle aperture 72 and be fixed to the front face of the mounting plate 30.

By manufacturing nozzle plate 70 separately from mounting plate 30, detailed nozzle work can be performed, without having to use the entire mounting plate 30 as a work piece. Furthermore, as will be apparent to one skilled in the art of plastic injection molding, nozzle plate 70 enables hollow brace members 58, hollow shaft socket 56 and mounting plate 30 to be molded as one piece thus minimizing the number of pieces to be attached. This is beneficial in that there is less assembly required and fewer attachments (e.g. welds), which tend to be structurally weak.

The way in which brace members are formed, however, is not essential to the invention described in the summary and could, for example, include forming a hollow semi-circular tube which is later sealed by end caps (not shown).

Figure 7A:
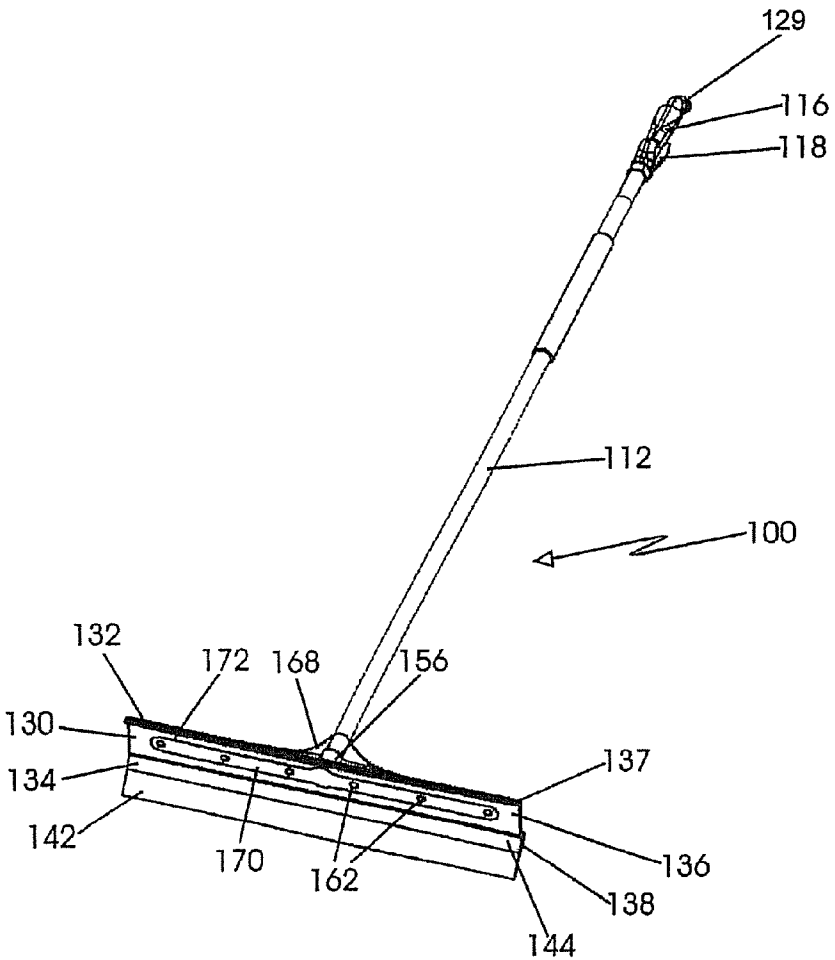
FIG. 7*a* presents an isometric view of a fluid squeegee in accordance with another embodiment of the present invention.

A further embodiment of the present invention is illustrated in FIGS. 7*a* to 11 *c*. The fluid squeegee 100 as shown in FIGS. 7*a* and 7*b* includes a squeegee head 114, a hollow shaft 112 and a handle 116. Similar to the squeegee 10 in FIGS. 1*a* and 1*b*, the hollow shaft 112 is a rigid tube that attaches to the head 114 and the handle 11 6 in a watertight manner such that water from a hose connected to the handle 116 will be conducted to the head 114. Handle 116 may include a press down type of fluid valve 118 to control the flow of the liquid to the head 114. Further, an elbow connector 129 may be inserted between the handle 116 and a hose so that the connected hose is not sharply bent and therefore crimped at the handle 116. The connector 129 may be rigid or it can be of the rotating type allowing the hose and the handle 116 to pivot relative to one another during its operations.

Figure 7B:
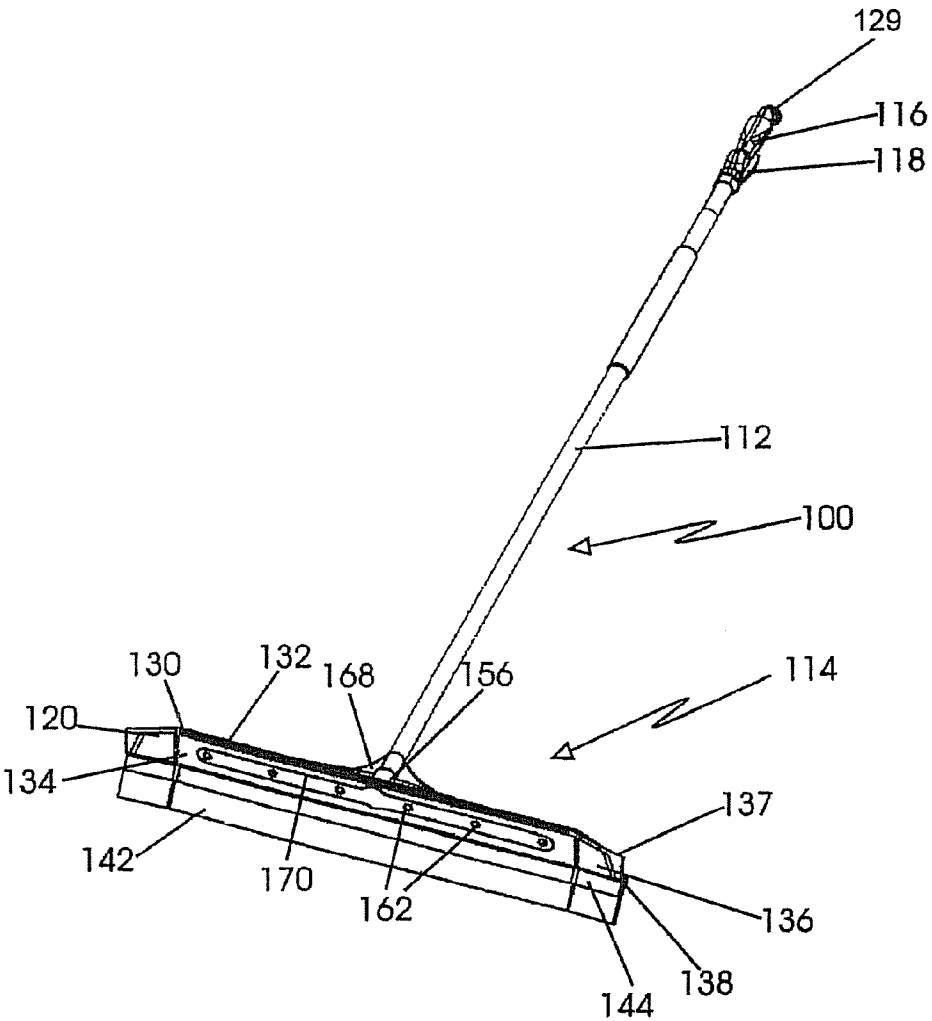
FIG. 7*b* illustrates an isometric view of a fluid squeegee having curved ends.
Figure 8A:
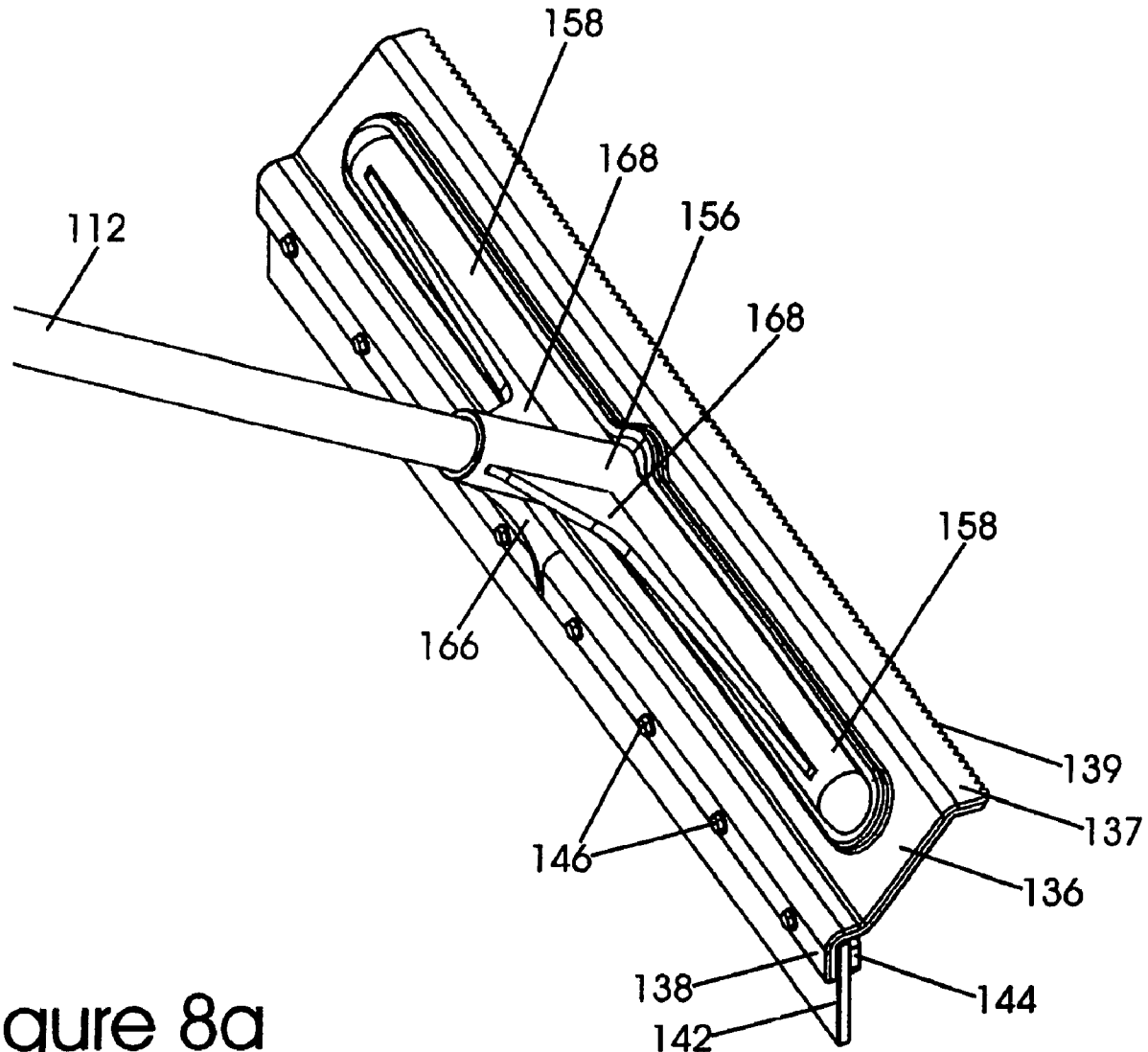
FIG. 8*a* illustrates the squeegee in FIG. 7*a* from the back.
Figure 8B:
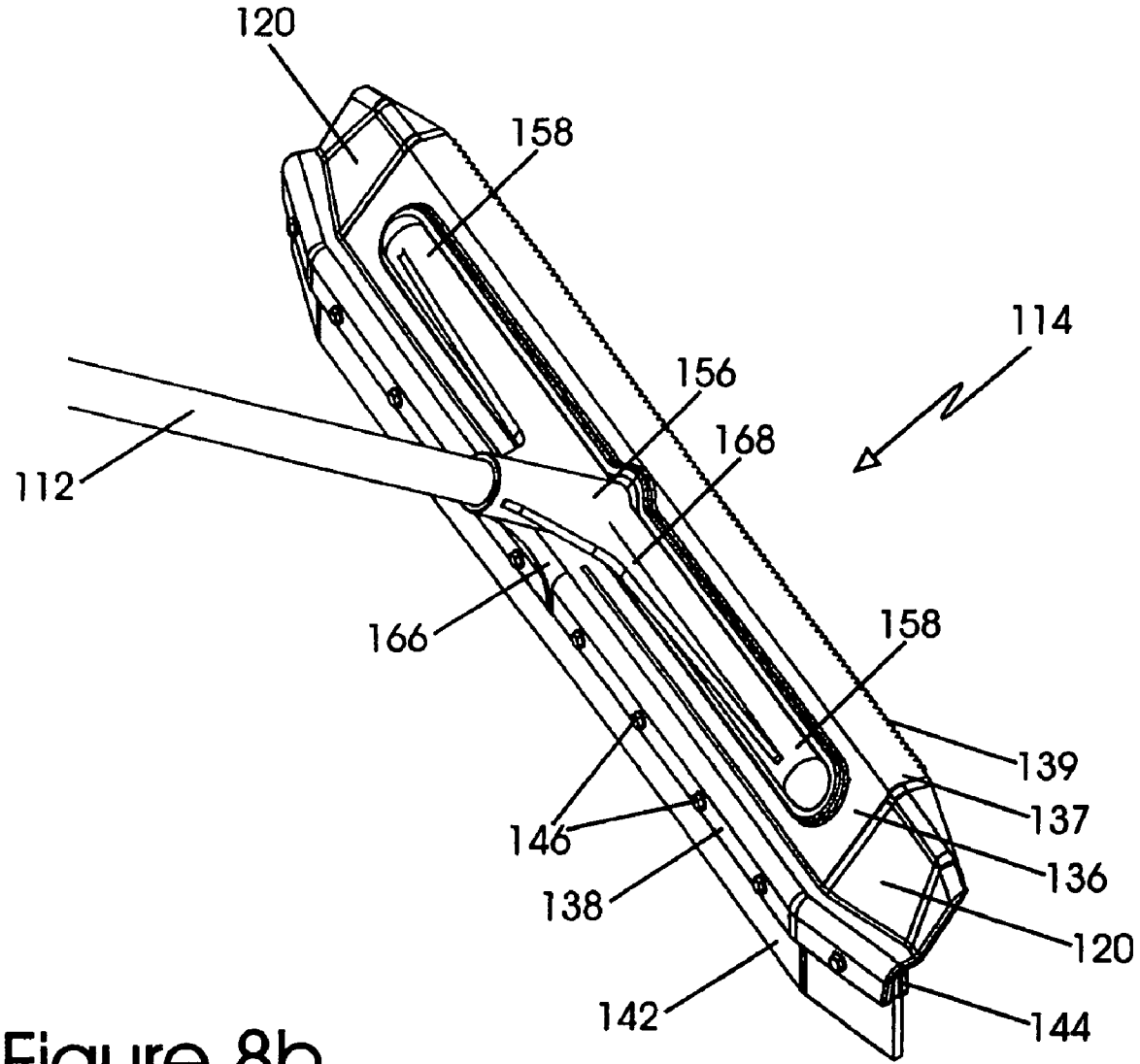
FIG. 8*b* illustrates the squeegee in FIG. 7*b* from the back.

FIGS. 7*a* and 7*b* show the squeegee 100 from the front, while FIGS. 8*a* and 8*b* show the squeegee head 114 from the back. The squeegee head 114 comprises an elongated mounting plate 130 having a front or discharge face 134 and a back or intake face 132. Further the mounting plate is in the form of a channel having a central web portion 136, an upperflange portion 137 and a lowerflange portion 138; both flange portions 137 and 138 generally extending towards the front of the squeegee head 114. A squeegee blade 142 is mounted to the lower flange 138. In this particular embodiment, a number of holes 140 are located in the lower flange 138. Screws 146 are passed through the holes 140 from the back face 132 of the lower flange 138, through corresponding holes in the squeegee blade 142 and then screwed into a squeegee blade mounting strip 144, which is an elongated strip running along the edge of the lower flange 138. The squeegee blade 142 is thus held in place.

FIGS. 7*a* and 8*a*, illustrate a type of squeegee head 114 that has a substantially planer channel shaped front face 134. On the other hand, FIG. 7*b* and 8*b* illustrate a type of squeegee head 114 wherein the ends 120 of the mounting plate 130 are curved forward such that the front or discharge face 134 has cupped ends to better control the fluid on the surface being cleaned.

FIGS. 7*a* and 7*b* also illustrate a squeegee head 114 having a nozzle plate 170, which is inserted into a nozzle aperture 172 in the web portion 136 of the mounting plate 130. A number of nozzles 162 are located in the nozzle plate 170 for discharging liquid from the head 114. FIGS. 8*a* and 8*b* illustrate hollow brace members 158 which are positioned on the back surface 132 of the web portion 136 of the mounting plate 130 and which are attached to a hollow shaft socket 156. The interior shape of the hollow brace members 158 may be generally semi-cylindrical shaped as shown in FIG. 5, U-shaped or may have other cross-sections such as semi-oval shaped. The hollow shaft socket 156 is adapted to receive the hollow shaft 112. Further ribs 168 are located on either side of the socket 156, connecting the socket 156 to the hollow brace members 158; and a support member 166 provides support between the socket 156 and the mounting plate 130. The ribs 168 and support member 166 strengthen the connection between the socket 156 and the hollow brace members 158.

Figure 9:
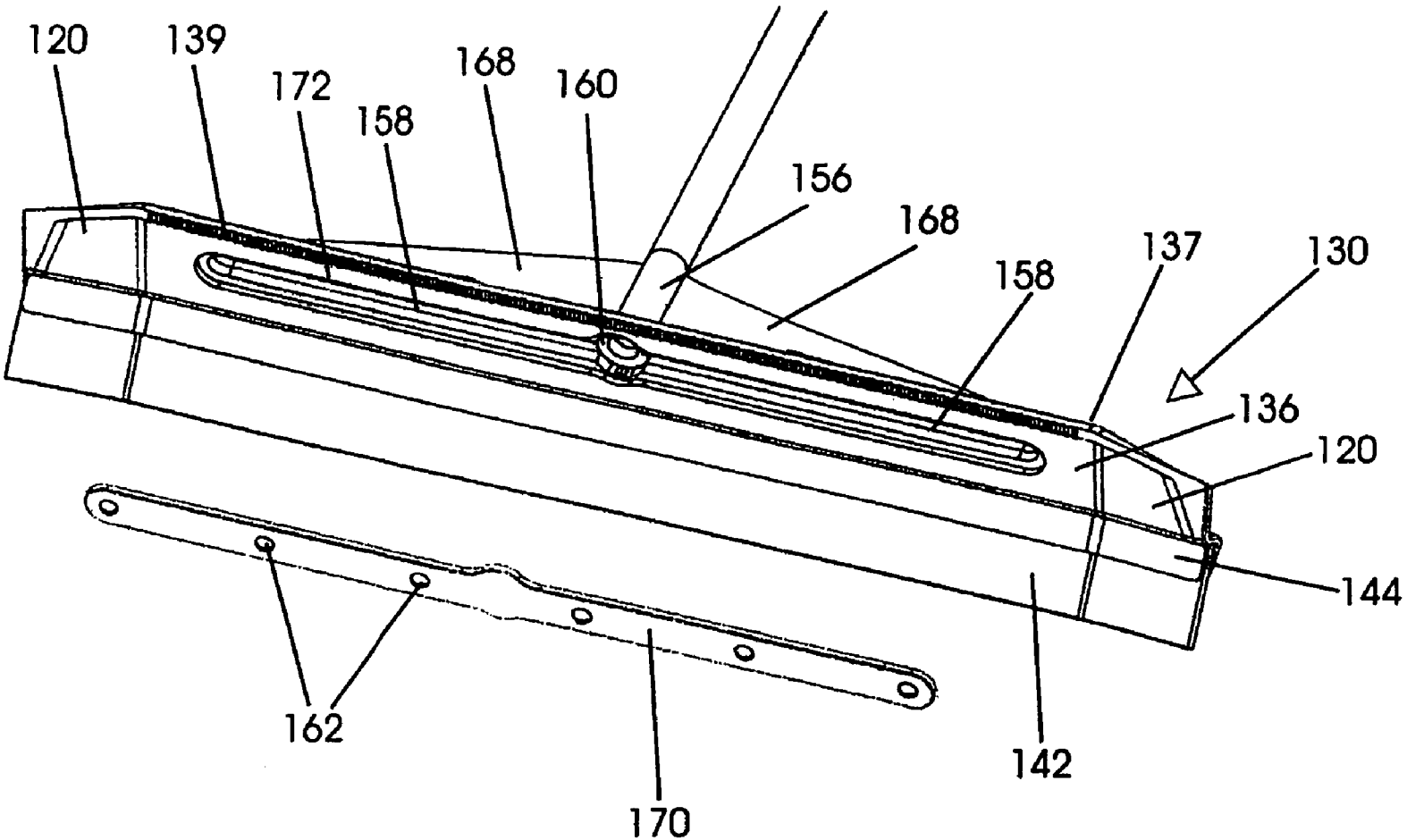
FIG. 9 illustrates the squeegee head in FIG. 7*a* in greater detail.

FIG. 9 shows the interior of the hollow brace members 158, which form passageways between the socket 156 and the nozzles 162. The nozzles 162 are located in a nozzle plate, which fits within a nozzle plate aperture 172 formed in the web section 136 of the mounting plate 130. When the nozzle plate 170 is in position, the space between the end of the socket 156 and the nozzle plate 170 form discharge ports 160 for liquid to flow into the hollow brace members 158 on either side of the socket 156.

FIG. 9 further illustrates the squeegee blade 142 held in place by the squeegee blade mounting strip 144, which is fastened to the edge of the lower flange 138. In addition, the edge 139 of the upper flange 137 is serrated; the serrated edge 139 may be used to dislodge materials from the surfaces that are being cleaned.

Figure 10A:
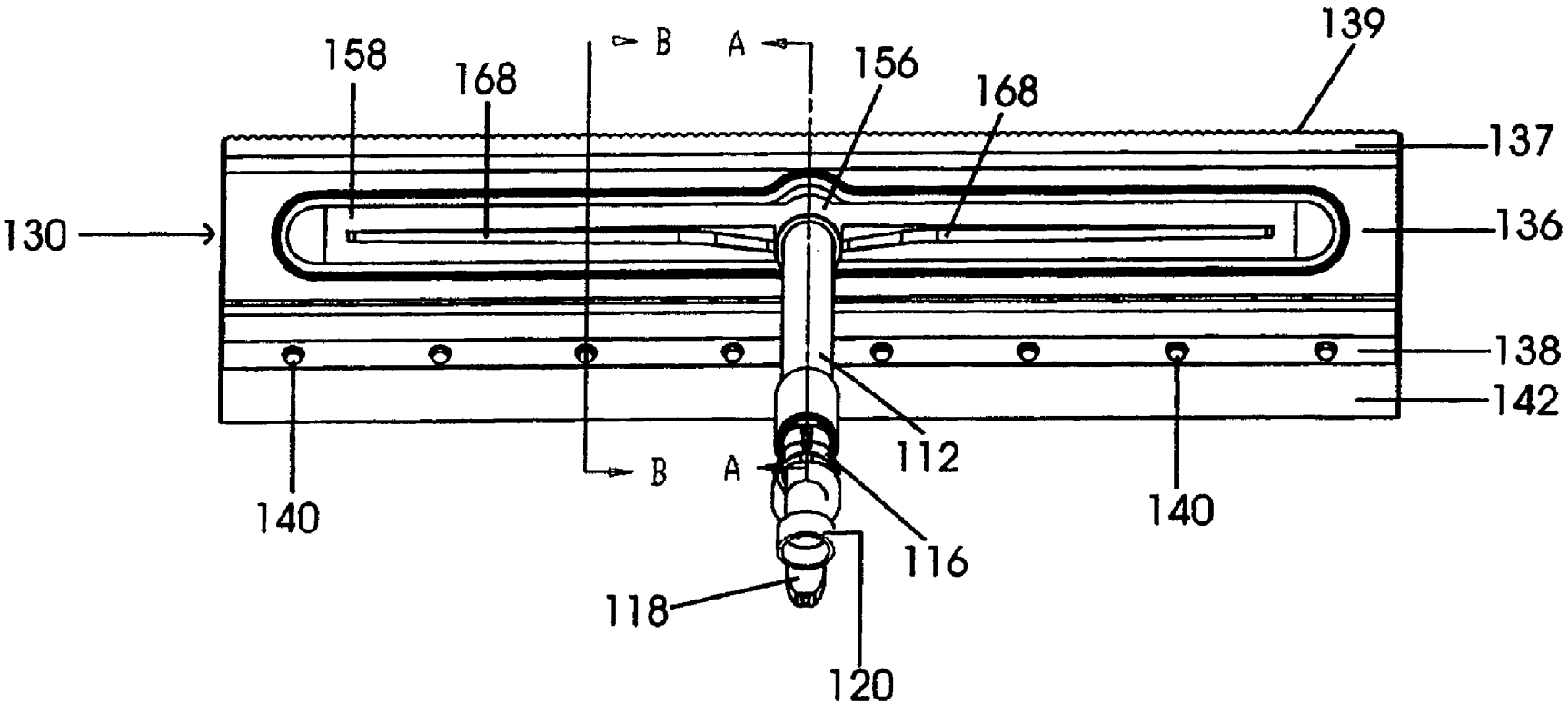
FIG. 10*a* is a back view of a squeegee head unit in accordance with an embodiment of the present invention.
Figure 10B:
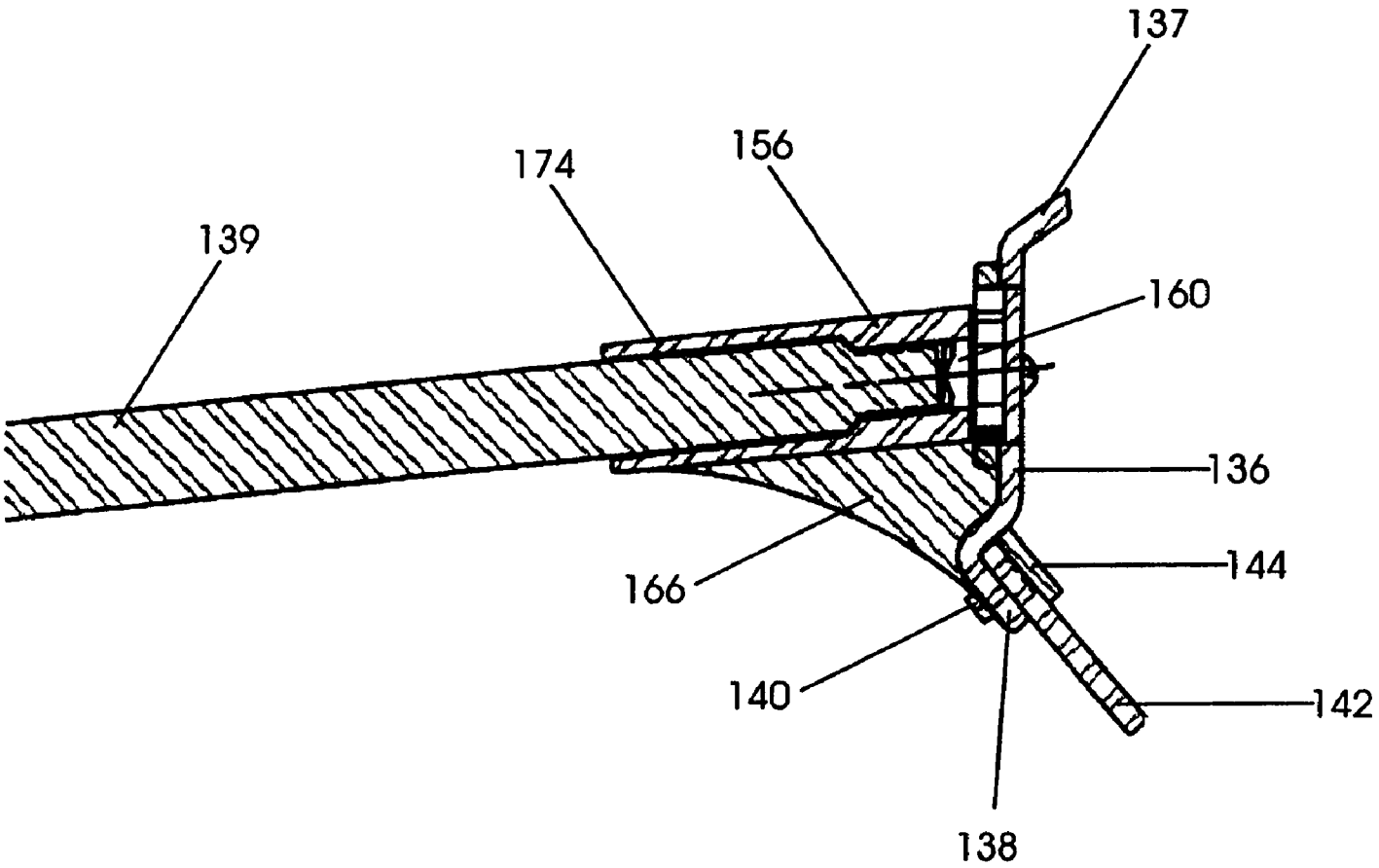
FIG. 10*b* is a cross-section of the squeegee head unit in FIG. 10*a* taken along the A-A plane.
Figure 10C:
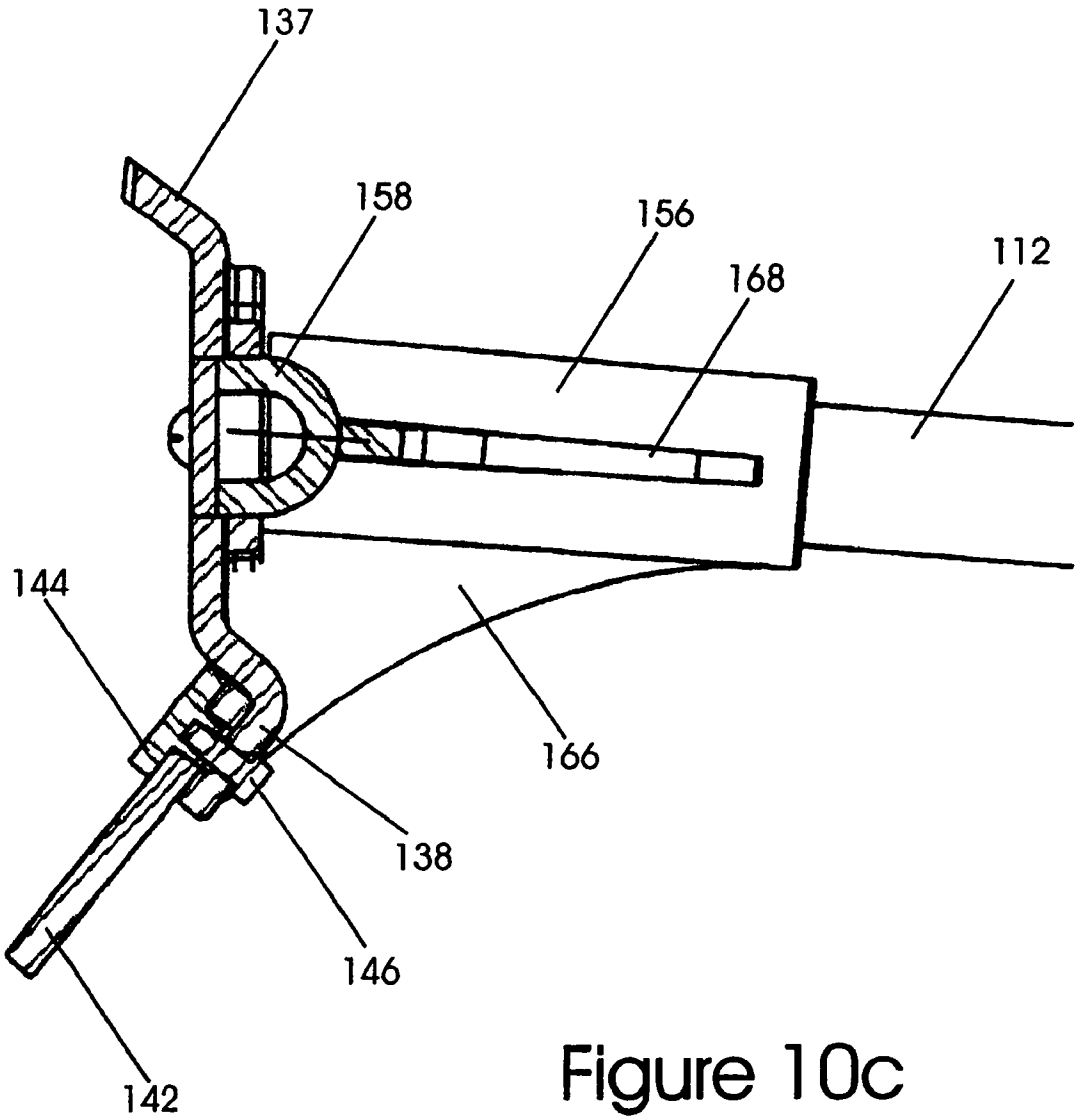
FIG. 10*c* is a cross-section of the squeegee head unit in FIG. 10*a* taken along the B-B plane.

In order to save assembly time and costs, a large portion of the squeegee head 114 may be molded as an integral unit. Such a unit is illustrated in FIG. 10*a* to 10*c*. FIG. 10*a* shows in back face view the squeegee head 114 having a mounting plate 130 comprising the web section 136 with the nozzle plate aperture 172 (not shown), the upper flange 137 with the serrated edge 139, and the lower flange with the holes 140 for attaching the squeegee blade. The unit further includes the socket 156 and the two hollow brace members 158. In FIG. l0*b*, which is a cross-section taken along the plane A-A, the interior of the socket 156 with threads to attach the hollow shaft 112 and the support member 166, are illustrated. The neck 174 of the socket 156 extends well beyond the threads within the socket 156. The extended neck 174 supports and reinforces the hollow shaft 112 to prevent flexing of the shaft 112 at a location around the threads, which is the weakest point on the shaft 112. Ports 160 are located behind the channel shaped mounting plate 130. In FIG. 10*c*, which is a cross-section taken along the plane B-B, support member 166 and rib 168 on the socket 156 are shown as well as the interior cross-section of the hollow brace members 158 that provide a passageway for the liquid flowing from the socket 156 to the nozzles 162.

Figure 11A:
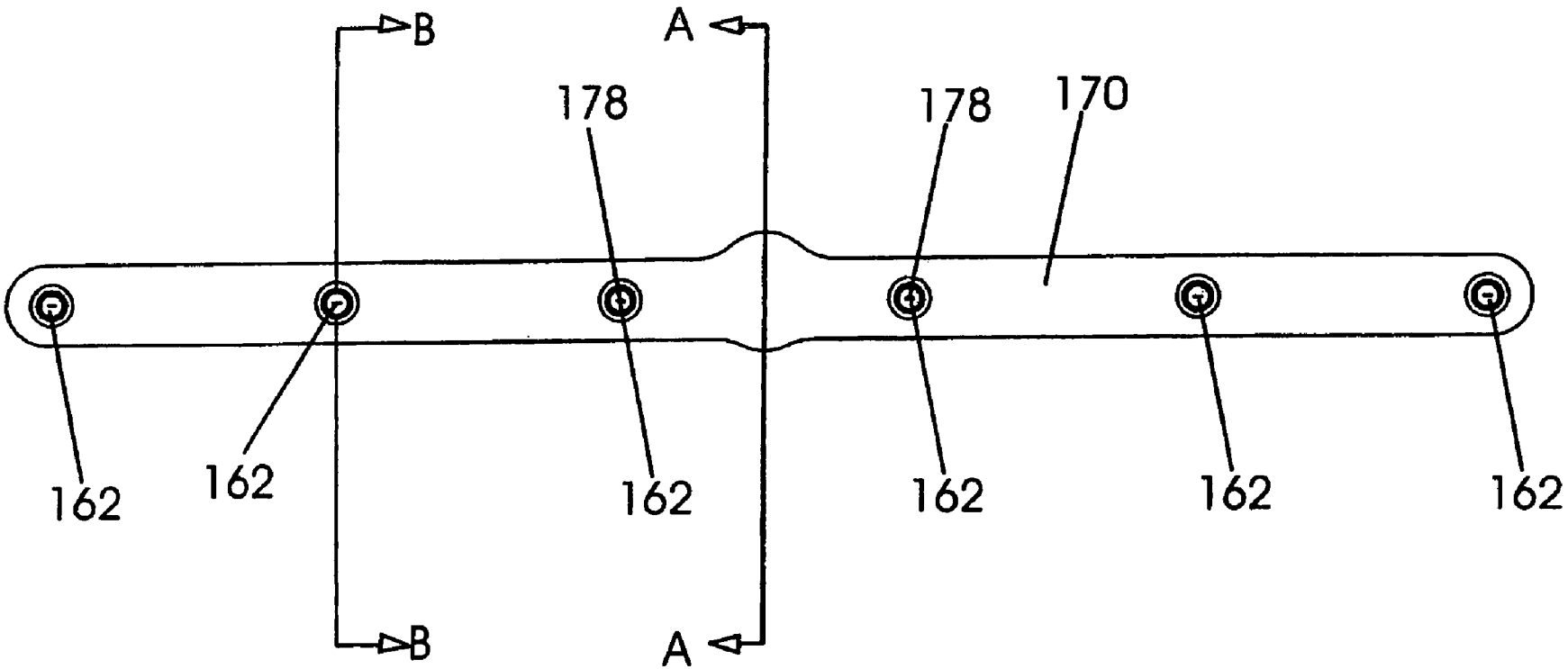
FIG. 11*a* is a back view of the nozzle plate in accordance with the present invention.
Figure 11B:
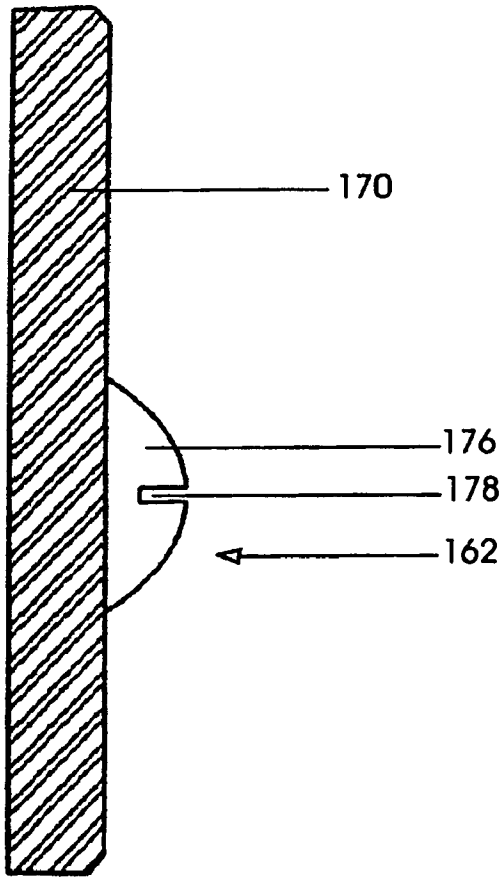
FIG. 11*b* is a cross-section of the nozzle plate in FIG. 11*a* taken along the A-A plane showing the nozzle.
Figure 11C:
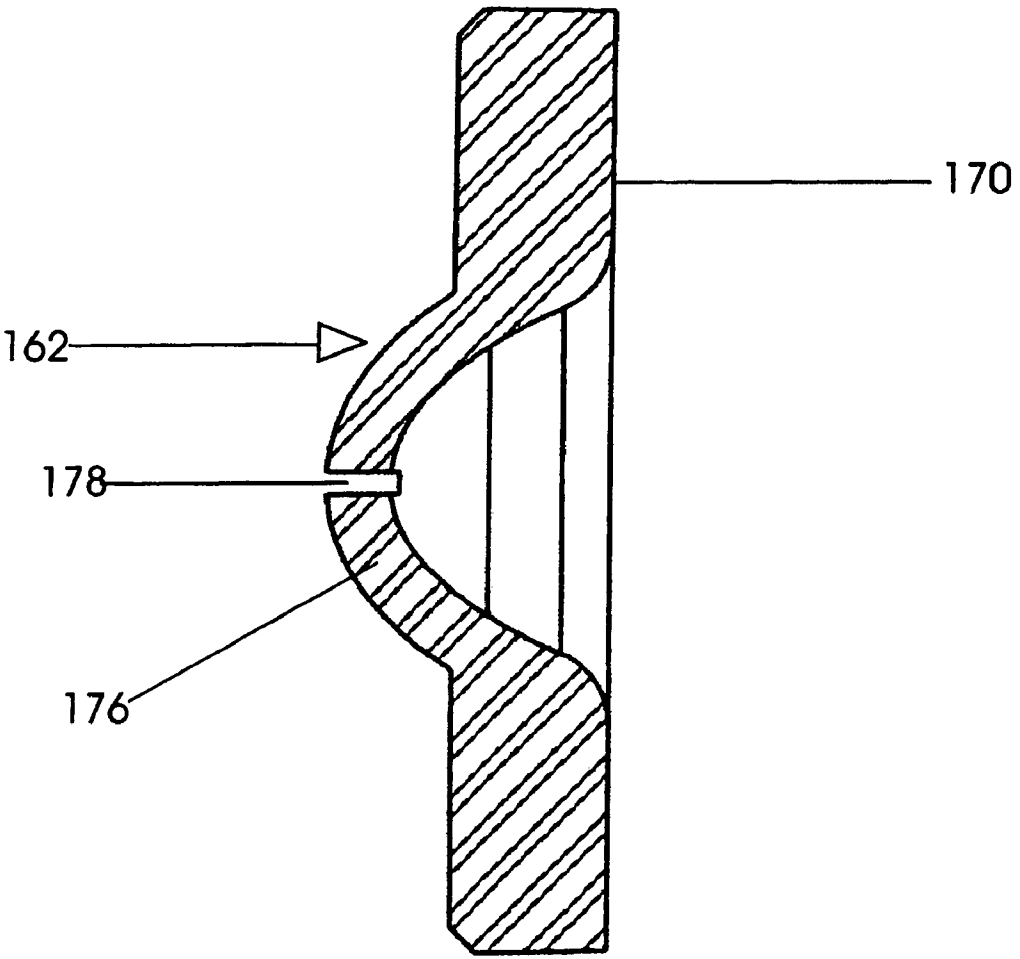
FIG. 11*c* is a cross-section of the nozzle plate in FIG. 11*a* taken along the B-B plane showing the nozzle in cross-section.

The nozzle plate 170 illustrated in FIG. 11*a* shows six nozzles 162 that are formed in the process of molding the plate 170. In this particular embodiment, as shown in FIGS. 11*b* and 11*c*, the nozzles 162 are in the form of bulges or protrusions 176 extending out of nozzle plate 170. Further, each protrusion 176 includes an opening 178 through which the fluid is discharged from the nozzle 162. The opening 178 is preferably in the form of a horizontal slit such that the fluid spreads out from each nozzle 162 in a fan shape.

Having set out all of the structural components, the operation of the fluid squeegee 10, 100 will now be described. Upon attachment of a fluid hose to hollow handle 16, I 16 fluid can be introduced into squeegee 10, 100 via valve 18, 118. As fluid flows through hollow fluid shaft 12, 112 it enters hollow shaft socket 56, 156 where it is then distributed to hollow brace members 58, 158. Fluid flowing through hollow brace members 58, 158 is then ejected onto a cleaning surface via nozzles 62, 162. By releasing valve member 18, 118 fluid flow through squeegee 10, 100 can be terminated. The squeegee operator can then whisk away the ejected fluids, utilizing squeegee blade 42, 142.

The embodiments of the present invention described above are beneficial over the prior art in that greater structural integrity is achieved between in the squeegee head 14, 114 through a structure having hollow brace members 58, 158 which provide rigidity and strength to the squeegee head, while at the same time providing passageways for fluid flow from the handle, hollow shaft and socket to the nozzles in the squeegee head.

While particular embodiments of the present invention have been shown and described, it is clear that changes and modifications may be made to such embodiments without departing from the true scope and spirit of the invention. Thus, it is intended that the present invention cover the modifications and variations of this invention provided they come within the scope of the appended claims and their equivalents.

What is claimed is:

1. A fluid squeegee head comprising:

a molded unit comprising:

a mounting plate defining a discharge face and an intake face, said mounting plate including a mounting portion for attaching a squeegee blade thereto and an aperture for receiving a nozzle plate;

a hollow shaft socket located on the intake face of said mounting plate, said hollow shaft socket adapted for attachment to a hollow fluid shaft, and said hollow shaft socket having one or more discharge ports formed therein; and one or more hollow brace members corresponding in number to the number of discharge ports formed in said hollow shaft socket, said one or more hollow brace members located on the intake face of the mounting plate and extend radially away from said one or more discharge ports for enclosing said nozzle plate aperture, whereby said one or more hollow brace members form a sealed fluid passageway between said one or more discharge ports and said nozzle plate aperture;

a nozzle plate mounted to the nozzle plate aperture, said nozzle plate having one or more nozzles; and a squeegee blade mounted to the squeegee mounting portion of the mounting plate.

2. A fluid squeegee head as claimed in claim 1 wherein each hollow brace member has an inner surface that is semi-conical in shape and wherein tapered ends of the semi-conical braces are furthest from the socket.

3. A fluid squeegee head as claimed in claim 1 wherein each hollow brace member has an inner surface that is semi-cylindrical in shape.

4. A fluid squeegee head as claimed in claim 1 wherein said mounting plate is channel shaped defining a web portion between a lower flange portion and an upper flange portion, the hollow socket, the hollow brace members and the nozzle plate aperture being located on the web portion and the squeegee mounting portion being located on the lower flange portion.

5. A fluid squeegee head as claimed in claim 4 wherein the upper flange portion has a serrated edge.

6. A fluid squeegee head as claimed in claim 5 wherein reinforcement ribs connect the hollow shaft socket and the hollow brace members.

7. A fluid squeegee head as claimed in claim 6 wherein a support member connects the hollow shaft socket and the intake face of the mounting plate.

8. A fluid squeegee head as claimed in claim 1 wherein the nozzle plate is inserted into and fixed to the nozzle plate aperture.

9. A fluid squeegee head as claimed in claim 1 wherein the mounting plate has ends that are curved inwardly toward the discharge face.

10. A fluid squeegee head as claimed in claim 1 wherein the hollow shaft socket has an extended portion adapted to support the hollow fluid shaft.

11. A fluid squeegee comprising a fluid squeegee head as claimed in claim 1 and further including: a hollow fluid shaft having an intake end and a discharge end, the discharge end being adapted for sealing attachment to the hollow shaft socket a hollow handle adapted for sealing attachment to said intake end of the hollow shaft and the hollow handle being adapted for sealing attachment to a fluid hose; and a valve mechanism located in the hollow handle for controlling fluid flow therethrough.

* * * * *